US009260282B2

(12) United States Patent
Laverty

(10) Patent No.: US 9,260,282 B2
(45) Date of Patent: Feb. 16, 2016

(54) METHOD OF OPENING A CAN WITH AN OPENING DEVICE

(76) Inventor: Ryan Michael Laverty, East Williston, NY (US)

( * ) Notice: Subject to any disclaimer, the term of this patent is extended or adjusted under 35 U.S.C. 154(b) by 408 days.

(21) Appl. No.: 13/606,800

(22) Filed: Sep. 7, 2012

(65) Prior Publication Data

US 2014/0069065 A1 Mar. 13, 2014

(51) Int. Cl.
*B67B 7/00* (2006.01)

(52) U.S. Cl.
CPC ..... *B67B 7/24* (2013.01)

(58) Field of Classification Search
CPC ..... B67B 7/16; B67B 7/30; B67B 2007/166; B67B 2007/303; B67B 7/24
USPC ..... 81/3.57, 3.27, 3.55; 7/151, 152, 153; D8/18, 40, 5, 107; 30/412–414
See application file for complete search history.

(56) References Cited

U.S. PATENT DOCUMENTS

| | | | | | |
|---|---|---|---|---|---|
| 140,088 | A | * | 6/1873 | Smith | 30/413 |
| 540,857 | A | * | 6/1895 | Franken | 30/413 |
| 862,710 | A | * | 8/1907 | Codville | 30/413 |
| 863,652 | A | * | 8/1907 | Ross | 30/414 |
| 1,267,154 | A | * | 5/1918 | Whitaker | 81/3.57 |
| 1,280,746 | A | * | 10/1918 | Jakubec | 30/413 |
| D54,364 | S | * | 2/1920 | Anderson et al. | 7/152 |
| 1,550,761 | A | * | 8/1925 | Tanner | 7/152 |
| 1,610,347 | A | * | 12/1926 | Wolfe | 81/3.57 |
| 1,699,329 | A | * | 1/1929 | Enderes | 30/413 |
| 1,928,028 | A | * | 9/1933 | Peterson | 30/279.6 |
| D91,134 | S | * | 12/1933 | Gioscio | D8/18 |
| 2,049,116 | A | * | 7/1936 | Harris | 30/414 |
| D102,425 | S | * | 12/1936 | Gatch | D8/DIG. 8 |
| D104,065 | S | * | 4/1937 | Hess | D8/107 |
| D104,082 | S | * | 4/1937 | Zimmer | D8/107 |
| D104,083 | S | * | 4/1937 | Zimmer | D8/107 |
| 2,105,119 | A | * | 1/1938 | Hindes | 76/119 |
| 2,106,639 | A | * | 1/1938 | Jenkinson | D8/40 |
| D111,489 | S | * | 9/1938 | Fischer | D7/395 |
| D116,555 | S | * | 9/1939 | Dreyfuss | D7/395 |
| D119,965 | S | * | 4/1940 | Paolantonio | D8/40 |
| 2,280,336 | A | * | 4/1942 | Maihack | D8/34 |
| 2,292,452 | A | * | 8/1942 | Kulling | 30/413 |
| 2,455,496 | A | * | 12/1948 | Kaskouras | 30/413 |

(Continued)

FOREIGN PATENT DOCUMENTS

| | | | |
|---|---|---|---|
| DE | 3317791 | A1 * | 5/1984 |
| FR | 1047617 | A * | 12/1953 |

(Continued)

*Primary Examiner* — Jason Daniel Prone
(74) *Attorney, Agent, or Firm* — Collard & Roe, P.C.

(57) ABSTRACT

There is a device for providing an easy opening in a beverage container such as a can. The device can comprise a body section, extending substantially along a longitudinal axis. This body section can comprise a first section having a rounded end. There can be a second section comprising a substantially flat section extending along the longitudinal axis. This second section comprises at least one first prong and a second prong comprising a hook which can extend to a sharpened section. The opening device is configured to create an opening in a metal can, wherein the first prong is configured to grip a bottom of a can, the second prong is spaced from the first prong and is configured to puncture a hole in the can when pressed, and the rounded end is configured to push through the opening to create a wider opening in the can.

18 Claims, 5 Drawing Sheets

(56) References Cited

U.S. PATENT DOCUMENTS

| | | | | | |
|---|---|---|---|---|---|
| 2,542,329 | A | * | 2/1951 | Hammond, Jr. | 81/3.57 |
| D164,842 | S | * | 10/1951 | Brown | D7/395 |
| 2,621,550 | A | * | 12/1952 | Bach | 81/3.57 |
| D173,606 | S | * | 12/1954 | Belpedio et al. | D8/18 |
| 2,697,275 | A | * | 12/1954 | Moyle | 7/152 |
| 2,858,721 | A | * | 11/1958 | Horne, Jr. | 7/152 |
| 3,122,774 | A | * | 3/1964 | Lamb | D8/107 |
| 3,153,851 | A | * | 10/1964 | Kazuo | D8/18 |
| D202,208 | S | * | 9/1965 | Bolduc | D8/18 |
| 3,305,924 | A | * | 2/1967 | Caravella | D8/18 |
| D221,614 | S | * | 8/1971 | McMahon | D8/107 |
| 3,602,396 | A | * | 8/1971 | Oates | D8/34 |
| 3,885,478 | A | * | 5/1975 | Evans | 81/3.55 |
| 4,034,595 | A | * | 7/1977 | Smith | 7/151 |
| 4,117,593 | A | * | 10/1978 | Piligrino | 30/314 |
| D254,834 | S | * | 4/1980 | Madsen et al. | D8/18 |
| 4,213,215 | A | * | 7/1980 | Hall | 7/152 |
| 4,309,921 | A | * | 1/1982 | Miller | 81/3.57 |
| 4,330,894 | A | * | 5/1982 | Hayden | 7/152 |
| 4,409,863 | A | * | 10/1983 | Anderson | 7/151 |
| 4,412,464 | A | * | 11/1983 | Cook | D8/40 |
| D276,304 | S | * | 11/1984 | DiFede | D8/40 |
| D278,307 | S | * | 4/1985 | Birchenall | D8/18 |
| D282,714 | S | * | 2/1986 | Harvey | D8/40 |
| 4,617,842 | A | * | 10/1986 | Yang | 81/3.55 |
| D301,196 | S | * | 5/1989 | Price | D8/18 |
| D301,826 | S | * | 6/1989 | Tucker | D8/18 |
| 4,864,898 | A | * | 9/1989 | Tricinella | 81/3.55 |
| D304,992 | S | * | 12/1989 | Matthies | D8/40 |
| 4,967,436 | A | * | 11/1990 | Russell | 81/3.57 |
| 4,976,172 | A | * | 12/1990 | Thomas et al. | 81/3.55 |
| 5,077,850 | A | * | 1/1992 | Brubaker | 7/151 |
| D385,162 | S | * | 10/1997 | Barrick | D8/18 |
| D388,680 | S | * | 1/1998 | Lin | D8/107 |
| D415,005 | S | * | 10/1999 | Chen | D8/107 |
| D433,899 | S | * | 11/2000 | Saffron et al. | D8/18 |
| 6,199,452 | B1 | * | 3/2001 | Vinar | 81/3.57 |
| D444,048 | S | * | 6/2001 | Mangione | D8/107 |
| D445,663 | S | * | 7/2001 | Chen | D8/107 |
| 6,354,174 | B1 | * | 3/2002 | Korwin | 81/3.55 |
| D466,768 | S | * | 12/2002 | Kelleghan | D8/18 |
| D466,769 | S | * | 12/2002 | Kelleghan | D8/18 |
| D466,770 | S | * | 12/2002 | Kelleghan | D8/40 |
| D467,480 | S | * | 12/2002 | Kelleghan | D8/40 |
| D472,125 | S | * | 3/2003 | Hsu | D8/107 |
| 6,640,369 | B1 | * | 11/2003 | Malvasio | 7/151 |
| D487,218 | S | * | 3/2004 | Aronson | D8/40 |
| D494,441 | S | * | 8/2004 | Chen | D8/107 |
| D496,236 | S | * | 9/2004 | Marsden et al. | D8/18 |
| D509,456 | S | * | 9/2005 | Ricci et al. | 81/3.09 |
| D524,549 | S | * | 7/2006 | Ajluni et al. | D4/128 |
| 7,313,983 | B1 | * | 1/2008 | Book | 81/3.55 |
| D600,084 | S | * | 9/2009 | Hbaiu | D8/40 |
| D637,469 | S | * | 5/2011 | Su | D8/107 |
| 8,484,785 | B1 | * | 7/2013 | Kristiansen et al. | 7/151 |
| D687,690 | S | * | 8/2013 | Chen | D8/107 |
| D700,498 | S | * | 3/2014 | Carter et al. | D8/107 |
| 8,695,457 | B2 | * | 4/2014 | Rozmus | B67B 7/16 30/450 |
| D707,507 | S | * | 6/2014 | Tran | D8/18 |
| D730,711 | S | * | 6/2015 | Chaffee et al. | D8/107 |
| 2005/0076742 | A1 | * | 4/2005 | Yurek et al. | 81/3.55 |
| 2006/0130613 | A1 | * | 6/2006 | Oleksy | 81/3.57 |
| 2007/0006685 | A1 | * | 1/2007 | Fok et al. | 81/3.55 |
| 2012/0285297 | A1 | * | 11/2012 | Rozmus et al. | 81/3.57 |
| 2014/0237952 | A1 | * | 8/2014 | Fesler | 81/3.47 |
| 2015/0101200 | A1 | * | 4/2015 | Arellano | B67B 7/24 30/448 |

FOREIGN PATENT DOCUMENTS

| | | | | |
|---|---|---|---|---|
| FR | 2507571 | A1 | * | 12/1982 |
| FR | 2529874 | A1 | * | 1/1984 |
| GB | 456605 | A | * | 11/1936 |
| GB | 515315 | A | * | 12/1939 |
| GB | 793344 | A | * | 4/1958 |
| GB | 817288 | A | * | 7/1959 |
| GB | 877003 | A | * | 9/1961 |
| GB | 1012437 | A | * | 12/1965 |
| GB | 1103805 | A | * | 2/1968 |
| NL | 9401347 | A | * | 4/1996 |

* cited by examiner

FIG. 1A
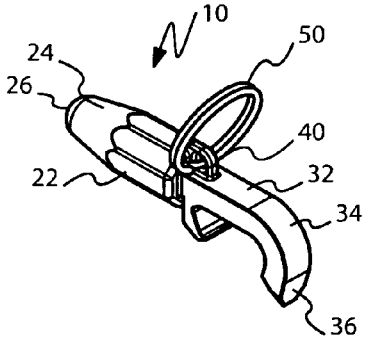
FIG. 1B
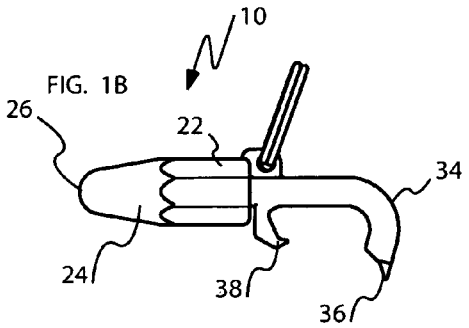
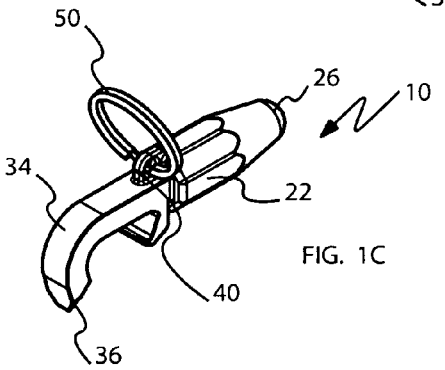
FIG. 1C
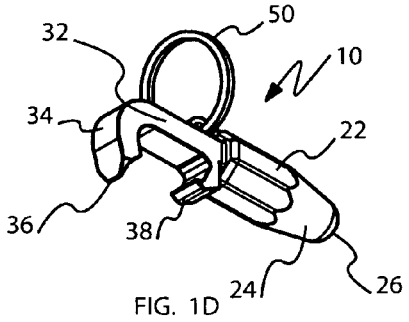
FIG. 1D
FIG. 1E
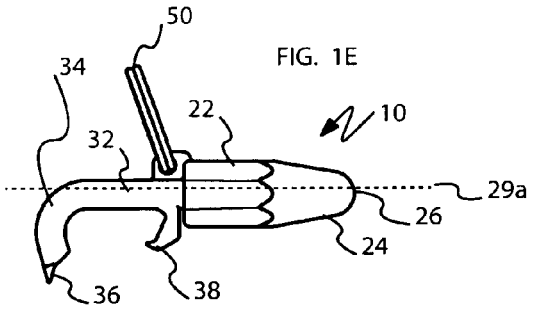
FIG. 1F
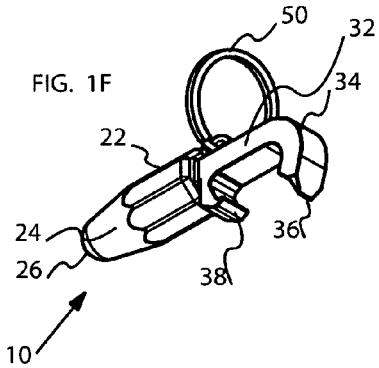

FIG. 2A
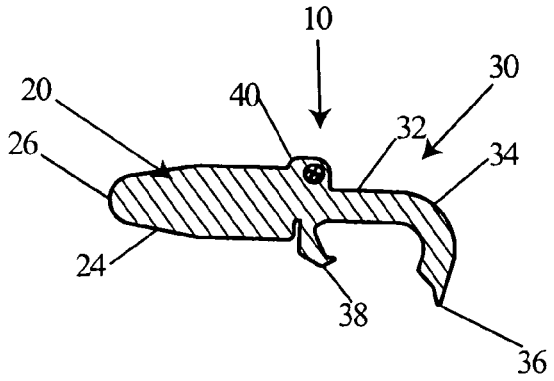
FIG. 2B
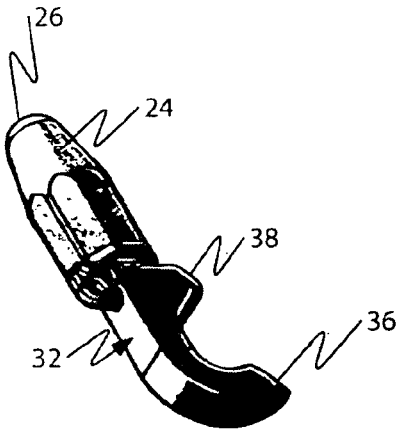
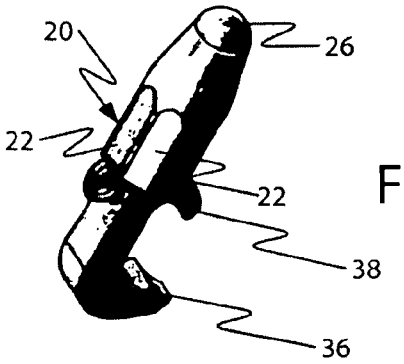
FIG. 2C

METHOD OF OPENING A CAN WITH AN OPENING DEVICE

BACKGROUND OF THE INVENTION

At least one embodiment of the invention relates to a can opening device which is configured to create at least one opening in a can. This opening in the can in at least one instance could be used for "shotgunning" the contents of the can. To "shotgun" the contents of the can the user must create at least two openings in the can and then drain the contents of the can from one of the openings while using the other opening to provide air or other fluid feed into the can to allow for the drop in fluid pressure inside of the can. To create an opening in the body of the container, can result in cuts to both the user's fingers as well as to their mouth if the opening if not created carefully enough.

Therefore, there is a need for a device or a tool which can be used to create an opening in a can while avoiding any injury to the user.

SUMMARY OF THE INVENTION

At least one embodiment of the invention relates to a beverage opener comprising a first end having a body section having a substantially cylindrical shape and a second end comprising a first prong and a second prong spaced from that first prong.

At least one additional embodiment for a modified can opener can comprise a body section, wherein the body section extends substantially along a longitudinal axis. This body section can comprise a first section having a first cylindrical section, a second frusto-conical section and a rounded end. There can be a second section comprising a substantially flat section extending along this longitudinal axis. This second section comprises at least one first prong extending substantially transverse to the longitudinal axis of the second section. There can be at least one second prong extending substantially transverse to the longitudinal axis of the second section. In this case, the first prong comprises a hook. The second prong can also comprise a hook. This second prong can also extend to a point. In this case, the opening device is configured to create an opening in a metal can, and wherein the first prong and the second prong form a substantially C-shaped section wherein the first prong is configured to grip a bottom of a can, the second prong is spaced from the first prong and is configured to puncture a hole in the can when pressed.

The invention can also relate to a process for creating an opening in a can comprising a plurality of different steps. These steps can comprise providing an opening device having a first end and a second end, the first end having a first prong and a second prong. The process can also include placing the first prong of the second end on a bottom of a can. The process can also include rotating the opening device so that the second prong of the second opening punctures the can. This process can also include removing the second prong of the second end from the opening in the can. This process can also include pressing the first end of the opening device into the can to create an opening. This process further comprises the step of creating a second opening in the can, and releasing at least a portion of any liquid contents of the can.

Thus, one of the advantages of this design is that it allows for the easy opening of a can and to remove the contents of the can without having the user cutting his fingers or his or her mouth on the can.

In addition, one of the other advantages of this invention is that it is a single piece compact device.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views:

FIG. 1A is a first perspective view of the device;

FIG. 1B is a side view of the device;

FIG. 1C is a back perspective view of the device;

FIG. 1D is a bottom perspective view of the device;

FIG. 1E is a side view of the device;

FIG. 1F is another back perspective view of the device;

FIG. 2A is a side cross-sectional view of the device;

FIG. 2B is a back perspective view of the device;

FIG. 2C is a front perspective view of the device

DETAILED DESCRIPTION

Figure 3A:
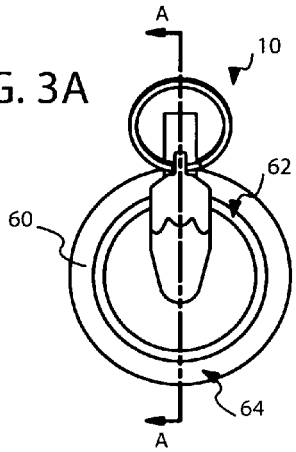
FIG. 3A is an end view of the device coupled to a can.

FIG. 1A-1F shows a series of different views of the device 10. Can opening device 10 includes a first end 20, and a second end 30. First end 20 is a substantially cylindrical end extending along a longitudinal axis 29 (See FIG. 1B). First end 20 includes a first section having flattened regions 22. Flattened regions 22 are used to allow user to grip this end for purposes of manipulating the device.

These plurality of flattened regions 22 are spaced radially around at least a portion of the first end 20, and wherein at least two of these flattened regions 22 are configured to provide easier grip for a user holding the beverage opener. The second section of first end is section 24. Second section 24 is a frusto-conical section which narrows to a third section 26. Third section 26 is a substantially rounded or bullnose section. This end forms a rounded end for use for blunt puncturing.

As shown in FIG. 1B, second end 30 comprises a first prong 38 and a second prong 36. First prong 38 and second prong 36 are spaced apart from each other along longitudinal axis 29*a* and a couple to each other via body section 32. In addition, there is also a curved extending section 34 which connects prong 36 with body section 32. Prongs 36 and 38 extend substantially transverse to longitudinal axis 29*a* of this device along latitudinal axis 29*b*. Prongs 36 and 38 form a substantially C shaped section. In addition, coupled to body section 32 is a connector 40. Connector 40 includes an opening 42 which is configured to receive a key ring. Thus this device can be used to couple to a key ring 50. While the device can be of any size it can extend approximately between 1 to 4 inches long.

Furthermore, hook or prong 36 can extend to a substantially narrowed or pointed section which can then be used to puncture a can such as a tin can or an aluminum can. This device can be made of any suitable material such as metal, wood or plastic. In at least one embodiment, the device can be made from ABS plastic. FIG. 1C shows a back perspective view of the device which shows rounded end section 34 which translates the axial extension from the longitudinal axis 29*a* to the latitudinal axis 29*b* thereby allowing prong 36 to extend substantially transverse or substantially perpendicular to the extension of the body section 32 as well as end section 20.

FIG. 1D is a back perspective end view of the device 10 which shows the C-shaped view of the prongs. FIG. 1E is a side view of the device which shows the longitudinal extension of axis 29*a* as well as the extension of axis 29*b*. FIG. 1F is a back perspective view of the device 10 as well.

FIG. 2A shows a side cross-sectional view of the device showing ends 20 and 30 as well as point or tip 36 used to further drive a hole into a can. The side view of the prongs or hooks 36 and 38 are shown in this view. FIGS. 2B and 2C show a side view of the device showing flattened sides 22 which can be used to allow the user to easily grip the device frusto-conical section 24 and end section 26 which is rounded or bullnose section. This view also shows hook 38 and prong 36.

Figure 3B:
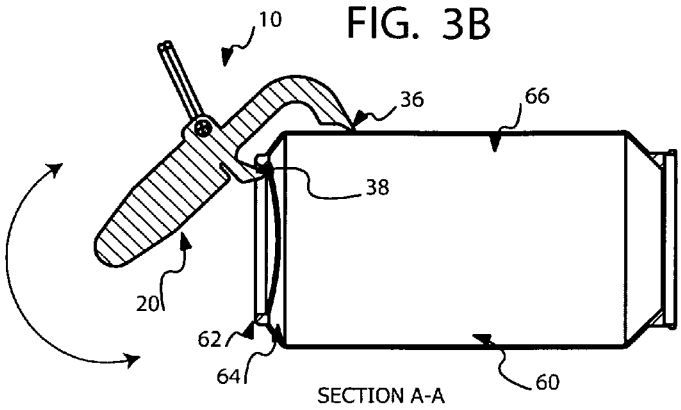
FIG. 3B is a side cross-sectional view of the device coupled to the can in a first position of rotation.
Figure 3C:
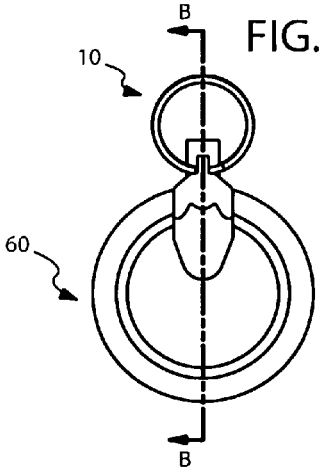
FIG. 3C is an end view of the device coupled to the can.
Figure 3D:
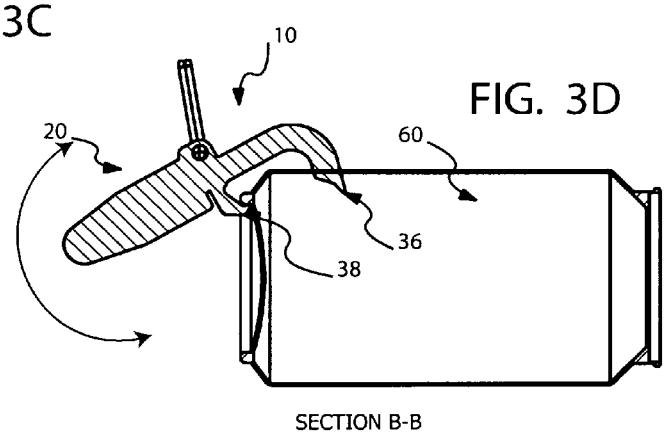
FIG. 3D is a side cross-sectional view of the device in a second position of rotation.
Figure 3E:
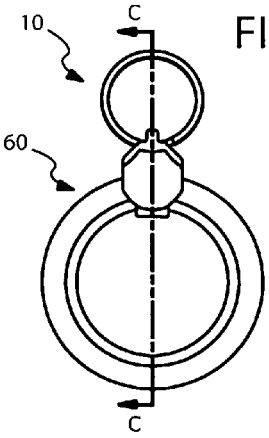
FIG. 3E is an end view of the device in another position of rotation.
Figure 3F:
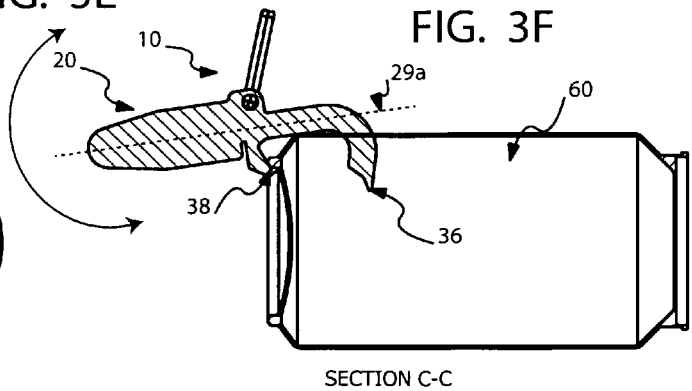
FIG. 3F is a side cross-sectional view of the device in another position of rotation.

FIGS. 3A-3F show the progression of rotation of the device as it moves through an opening movement. For example, FIG. 3A shows an end view of the device 10 coupled to can 60. FIG. 3B shows a side cross sectional view of the device 10 as it is coupled to can 60 taken along the line A-A. The device is shown having prong 38 coupled to a first end section 62 of can 60. This coupling point forms an axis of rotation wherein this rotation is around this coupling point. This side view also shows the tapered section 64 as well as the body section 66 of can 60. FIG. 3C shows a second end view of the device 10 coupled to can 60. FIG. 3D shows a side view of device 10 coupled to can 60 in a second position of rotation. As shown, prong 36 has punctured body section 66 and has entered into the volume of the can. Prong 38 is coupled to end section 62 forming this axis of rotation. FIG. 3E shows the end view of the axis of rotation wherein this end view shows device in the fully rotated position completely puncturing the body of the can. FIG. 3F shows a side view of this position as well. In this position, prong 36 is fully extended through body section 66 and forming a fully punctured section of the can thereby creating an opening in the can.

Figure 4:
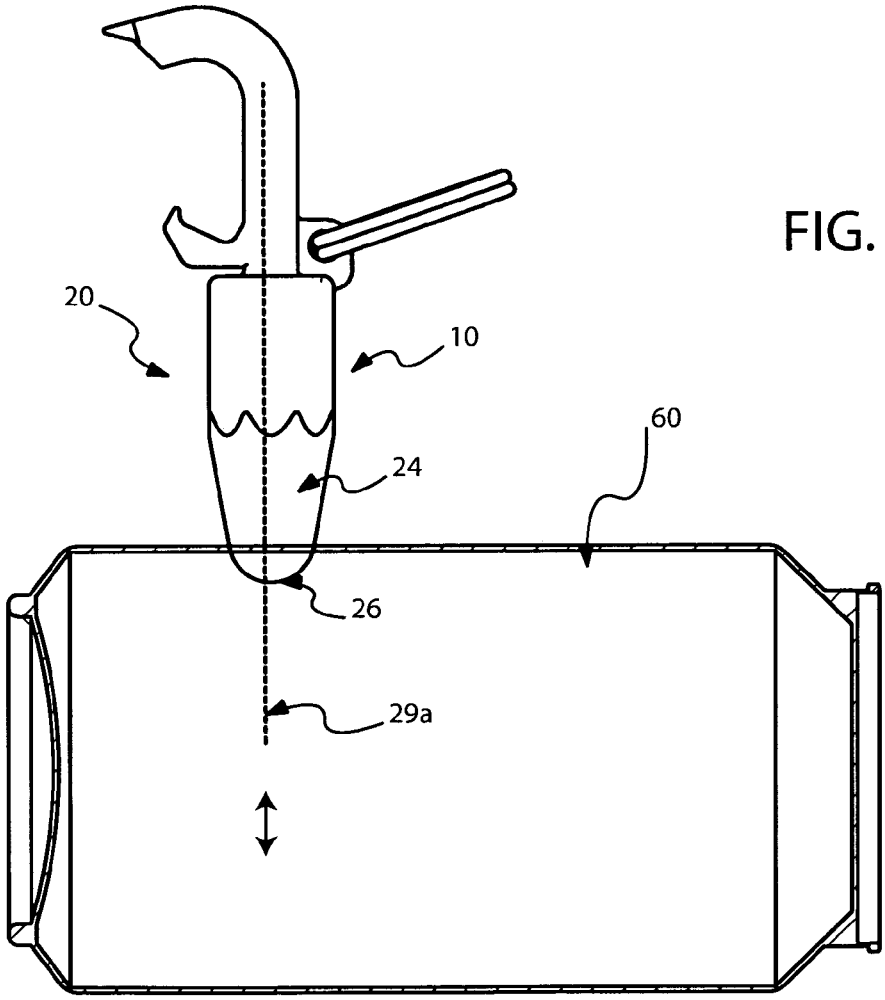
FIG. 4 is a side view of the device as it is being inserted into a can.

FIG. 4 is a side view of the can showing the device 10 extending through the opening in the can 60. At this position, end 26 is shown puncturing the already created opening in the can which was created by prong 36 as shown in the progression shown in FIGS. 3A-3F. The movement of this device is shown as moving substantially along longitudinal axis 29*a*. This movement of the device creates a rounded opening in the can which clears a safe opening in the can. This rounded punctured safe opening is important because it will keep a person from being cut if they drink out of this opening.

Figure 5:
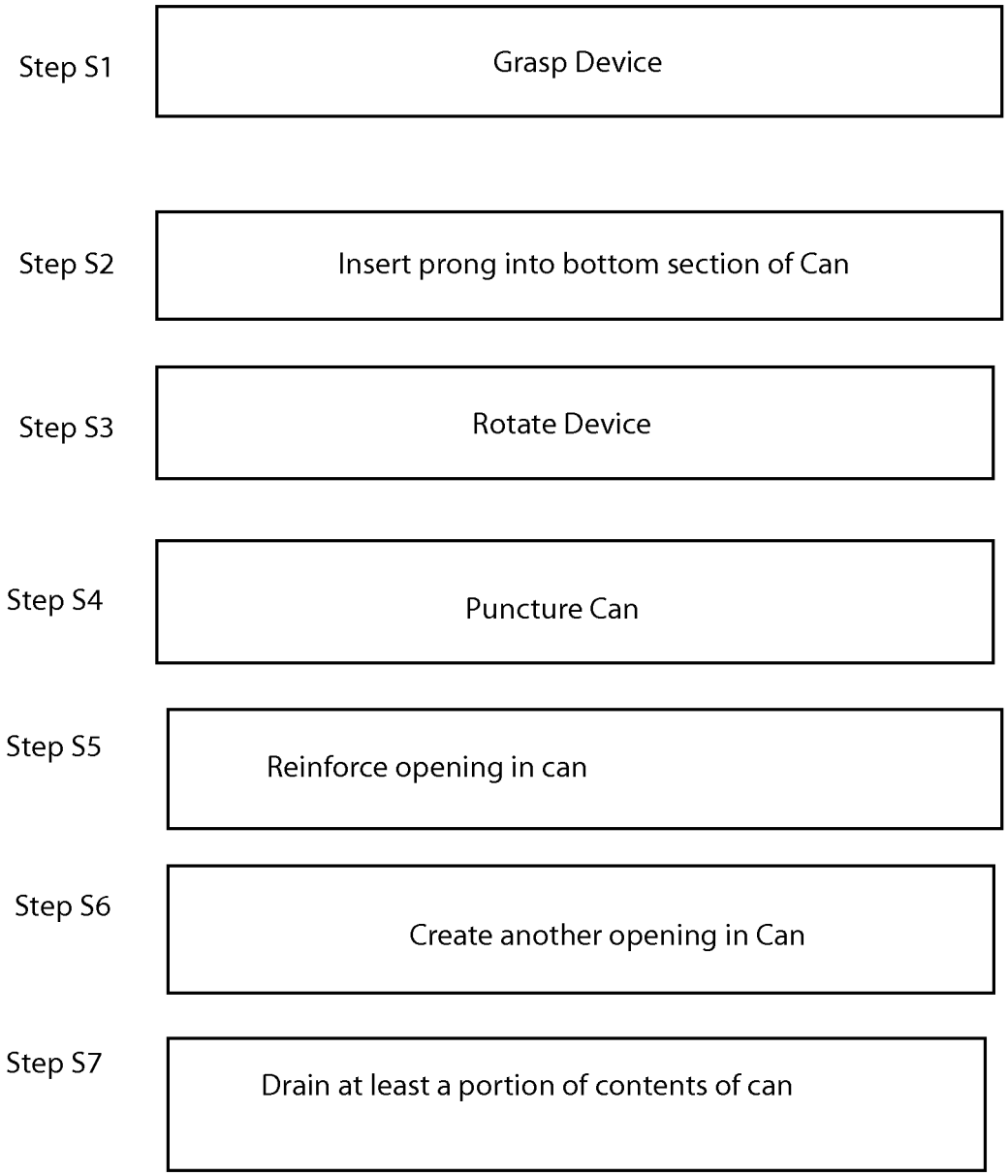
FIG. 5 is a flow chart for the use of the device with the can.

FIG. 5 shows the flow chart for the progression of the opening of the can. For example, in step S1 a user can grasp the device and then insert prong 38 into the bottom of the can in section 62 in step S2. Next, in step S3 the user can rotate the device or the can relative to the device and drive prong 36 into the side of the can, particularly into the body portion 66. Next, in step S4 the can is punctured thereby creating a hole in the can. (See FIGS. 3D and 3F). Next, in step S5, the user can take another end 26 and drive it further through the opening of the can to reinforce the opening in the can. Next, in step S6 the user can create another opening in the can thereby allowing for air flow in the can and decreasing the pressure inside of the can. Next, in step S7 the user can drain at least a portion of the contents of the can into the user's mouth thereby allowing for a rapid flow of contents into the user.

Thus, this design of the device creates a can having at least two different ends for creating openings in the can and for allowing for a single self-contained device which has at least two different ends for creating two different kinds of openings.

Accordingly, while at least one embodiment of the present invention have been shown and described, it is to be understood that many changes and modifications may be made thereunto without departing from the spirit and scope of the invention as defined in the appended claims.

The invention claimed is:

1. A method for opening a can with an opening device having a working section having first and second spaced prongs and a body section having a first portion with a substantially conical shape defining a rounded end and a second portion, the method comprising gripping said second portion of said body section and placing said first prong of said working section on a bottom of a can; rotating said opening device so that said second prong of said working section punctures an opening in a side of said can; removing said second prong from said opening in said can; and pressing said rounded end of said body section into said opening to round portions of the can defining said opening.

2. The method as in claim 1, said can is a beverage can.

3. The method as in claim 1, said second portion has at least one flattened region.

4. The method as in claim 3, said at least one flattened region is a plurality of flattened regions that are radially positioned around said second portion to define a grip.

5. The method as in claim 1, said first prong is curved.

6. The method as in claim 5, said second prong is curved.

7. The method as in claim 6, said first prong and said second prong extend transverse to a longitudinal axis of said body section of said first end.

8. The method as in claim 1, said first prong and said second prong of said second section are coupled together to form a substantially "C" shape.

9. The method as in claim 8, further comprising at least one connector for connecting said opening device to another object.

10. The method as in claim 9, said at least one connector is an aperture and a key ring received in said aperture.

11. The method as in claim 1, a length of a combination of said first and second portions of said body section and a length of said working section are approximately equal.

12. The method as in claim 1, said opening device is made from a polymer.

13. The method as in claim 1, said opening device is one piece.

14. A method for opening a can with an opening device having a body portion defining a longitudinal axis and having a first cylindrical section, a second frusto-conical section, and a rounded end and a working portion having at least one first prong extending substantially transverse to said longitudinal axis, at least one second prong extending substantially transverse to said longitudinal axis, and a substantially flat section connecting said prongs and extending substantially parallel to said longitudinal axis, the method comprising gripping said first cylindrical section and placing said first prong of said working portion on a bottom of a can; rotating said opening device so that said second prong of said working portion punctures an opening in a side of said can; removing said second prong from said opening in said can; and pressing said rounded end of said body portion into said opening to round portions of the can defining said opening.

15. The method as in claim 14, said at least one first prong is a hook.

16. The method as in claim 14, said at least one second prong is a hook.

17. The method as in claim 16, said at least one second prong has a pointed end.

18. The method as in claim 14, said at least one first prong, said substantially flat section, and said at least one second prong together have a substantially C-shape.

* * * * *